United States Patent [19]

Barth

[11] 3,966,070

[45] June 29, 1976

[54] MECHANISM FOR LOADER BUCKET OR FORKLIFT MAST ON A MATERIAL HANDLING VEHICLE

[75] Inventor: John W. Barth, Topeka, Kans.

[73] Assignee: Allis-Chalmers Corporation, Milwaukee, Wis.

[22] Filed: Oct. 7, 1974

[21] Appl. No.: 512,736

[52] U.S. Cl. ..... 214/776; 37/117.5; 214/620

[51] Int. Cl.[2] ..... E02F 3/70

[58] Field of Search ..... 214/776, 145, 131 A, 214/773, 775, 777, 620, 770, 750, DIG. 5; 37/117.5, 118

[56] References Cited

UNITED STATES PATENTS

| | | | |
|---|---|---|---|
| 2,421,472 | 6/1947 | Way | 214/DIG. 5 |
| 3,001,654 | 9/1961 | Albert | 214/776 |
| 3,227,300 | 1/1966 | Kampert | 214/776 |
| 3,410,433 | 11/1968 | Brown | 214/770 |
| 3,432,051 | 3/1969 | Borer et al. | 214/775 |
| 3,504,451 | 4/1970 | Brueske | 37/118 |
| 3,510,017 | 5/1970 | Guinot | 37/118 |

*Primary Examiner*—Frank E. Werner
*Assistant Examiner*—Ross Weaver
*Attorney, Agent, or Firm*—Arthur L. Nelson

[57] ABSTRACT

A mechanism on a material handling vehicle having means for interchangeably connecting an attachment to operate as a front end loader or a forklift with an extendable mast for loading and handling of material. The mechanism includes a quadrilateral linkage having means in the linkages adapting the linkage for attaching a front end loader bucket or the mast of a forklift.

10 Claims, 3 Drawing Figures

1
2
3
4
5
6
7
8
9
10
11
12
13
14
15
16
17
18
19
20
21
22
26
27
28
29
30
31
32
33
34
35
36
37
38
39
70
72
74
76

MECHANISM FOR LOADER BUCKET OR FORKLIFT MAST ON A MATERIAL HANDLING VEHICLE

This invention relates to material handling vehicles and more particularly to a mechanism for a front end loader and forklift vehicle for handling materials. The mechanism includes a quadrilateral linkage with an adjustable crossarm to adapt the mechanism for interchangeably carrying a bucket attachment to operate the vehicle as a front end loader or a forklift with a mast supporting carriage including a fork attachment.

Front end loader vehicles employ various mechanisms for supporting a bucket attachment which can be used to scoop up materials for loading in cargo carrying vehicles such as trucks. Although the linkages for supporting the bucket may take various forms, they are usually operated hydraulically by the operator at the operator's station, and the bucket is generally pivotally supported at the extreme end of a boom structure. A control linkage is provided to tilt the bucket and provide a leveling control on the bucket while the bucket is raised or moved to the unloading area.

There is, however, a need for the forklift type of vehicle in which a fork is positioned on a carriage which can be moved vertically on a mast. A conventional control mechanism is provided to operate the carriage which is moved vertically on the mast to raise or lower the load from its loading position to its unloading position. This type of vehicle is also quite generally used in industry.

There is also a need for a more versatile type vehicle which can interchangeably be used as a front end loader or a forklift truck. Accordingly, this invention provides for such a vehicle. The mechanism which supports the bucket attachment or the mast for a forklift carriage has an interchangeable mount on the forward end of a boom structure. A crossarm is provided which can be selectively interconnected to the leveling cylinder and leveling link.

It is an object of this invention to provide a lift mechanism for a front end loader adapted for use with a bucket attachment or a mast of a forklift truck.

It is another object of this invention to provide a lift mechanism for a material handling vehicle adapted for operation with a bucket attachment or a mast and carriage of a forklift truck.

It is a further object of this invention to provide a lift linkage for a material handling vehicle for operation with a bucket attachment or mast and carriage of a forklift whereby the load on the carriage when partially extended moves substantially vertical although the lower end of the mast moves slightly forward as the boom pivots upwardly.

The objects of this invention are accomplished by a material handling vehicle in which the front end includes a pivotally supported boom with hydraulic actuators connected to the boom supporting structure for pivotally raising and lowering the boom. A crossarm is pivotally supported on the intermediate portion of the boom. A leveling cylinder is pivotally connected between the intermediate portion of the crossarm and the upper portion of the boom supporting structure. Extending forwardly from the crossarm at a point above the connection for the leveling cylinder is connected a leveling link. This link is connected to a bucket at a point above the connection of the bucket to the forward end of the boom. Accordingly, the bucket is pivotally supported on the boom and controlled by the leveling linkage from the operator station of the vehicle. The mechanism provides a material handling vehicle with a bucket attachment which can be operated through controls at the operator station.

The mechanism is adapted for changing the connecting points of the leveling cylinder and leveling link to the crossarm. With a connection of the leveling cylinder on the crossarm at a lower point and a connection of the leveling link at a higher point on the crossarm the forklift mast can be mounted and operated. This provides quadrilateral linkages in which the leveling cylinder controls the movement of the crossarm which in turn controls the position of the boom supported mast carrying the forklift carriage.

As the lifting mechanism is lifting the mast tilts slightly rearwardly as the lower end of the boom arcs slightly forwardly which maintains a load carrying position for the load on the fork carriage. If the load carried on the fork carriage is initially elevated on the mast to the height of the boom supporting structure, the load carried on the fork carriage will move substantially vertical although the base end of the mast moves arcuately forward as the boom raises the mast. This movement provides for a measure of safety in raising of the load on the mast and assures stability through better weight distribution of the vehicle. A larger hydraulic cylinder may be used with the mast and fork carriage as compared to the bucket attachment if the operator should so desire.

The movement provided by the linkage has the added safety feature in the event of hydraulic failure, the load will lower without falling from the fork carriage or upsetting the vehicle. The quadrilateral linkage together with the limit stops in the leveling cylinder provide this safety feature.

The preferred embodiments of this invention are illustrated in the attached drawings.

Figure 1:
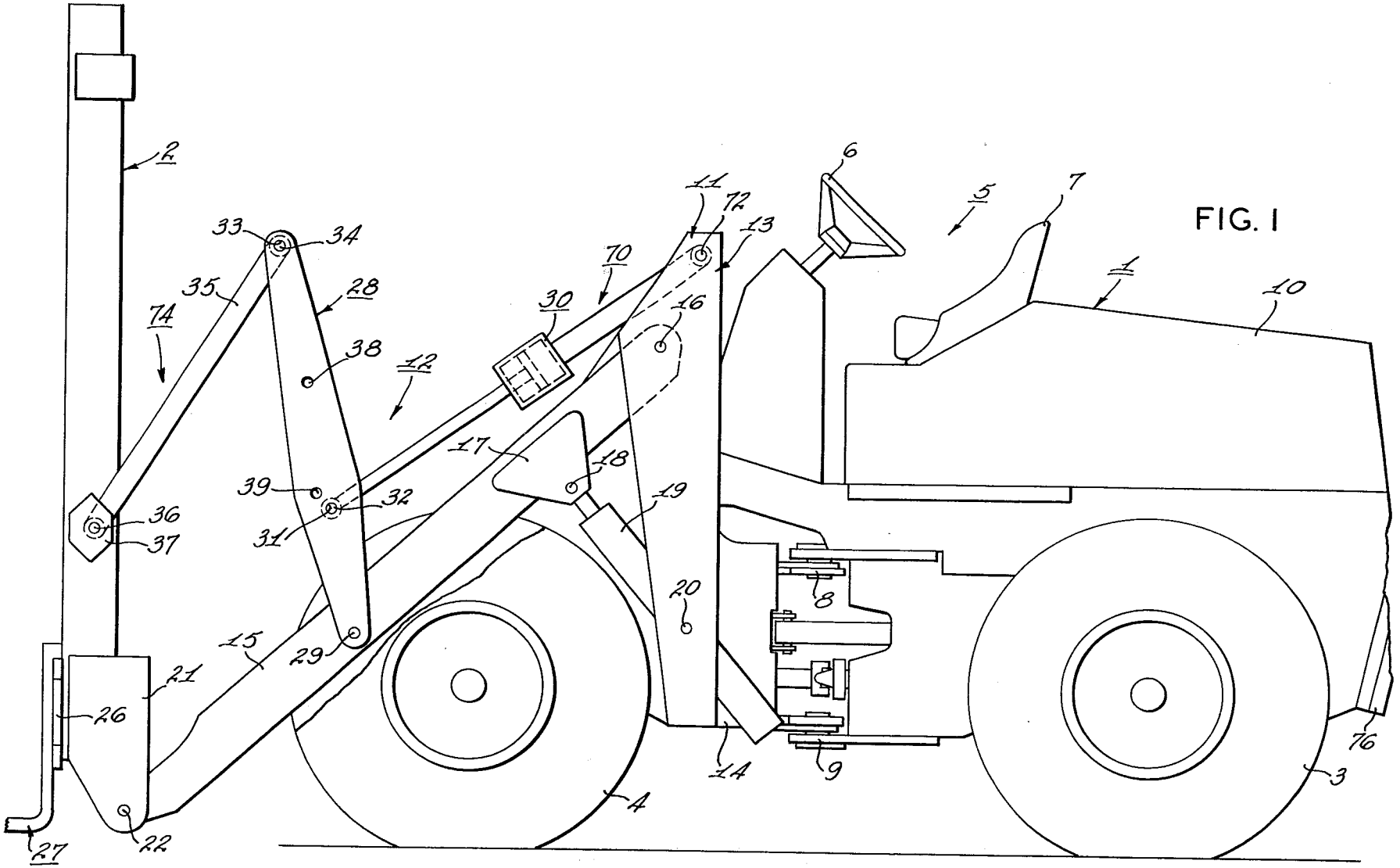
FIG. 1 illustrates a side elevation view of the material handling vehicle with a load carrying mechanism carrying a mast and a forklift attachment.

Referring to the drawings, FIG. 1 illustrates a side elevation view of the material handling vehicle 1 with a forklift mast 2. The vehicle 1 is supported on the rear wheels 3 and front wheels 4. The operator station 5 is defined by the steering wheel 6 and operator seat 7. The vehicle is articulated at the bearings 8 and 9. The rear section 10 defines the operator station 5 while the front section 11 carries the load supporting mechanism 12 with symmetrical linkages on each side of the vehicle of which one side is shown. A pair of upright supports 13 are mounted on the front frame 14. The upright supports 13 support a pair of booms 15 on a pair of pins 16. A bracket 17 on each boom 15 is pivotally connected by a pin 18 to a hydraulic ram 19. Each hydraulic ram 19 is connected by a trunnion pin 20 on its mating upright support 13.

Figure 3:
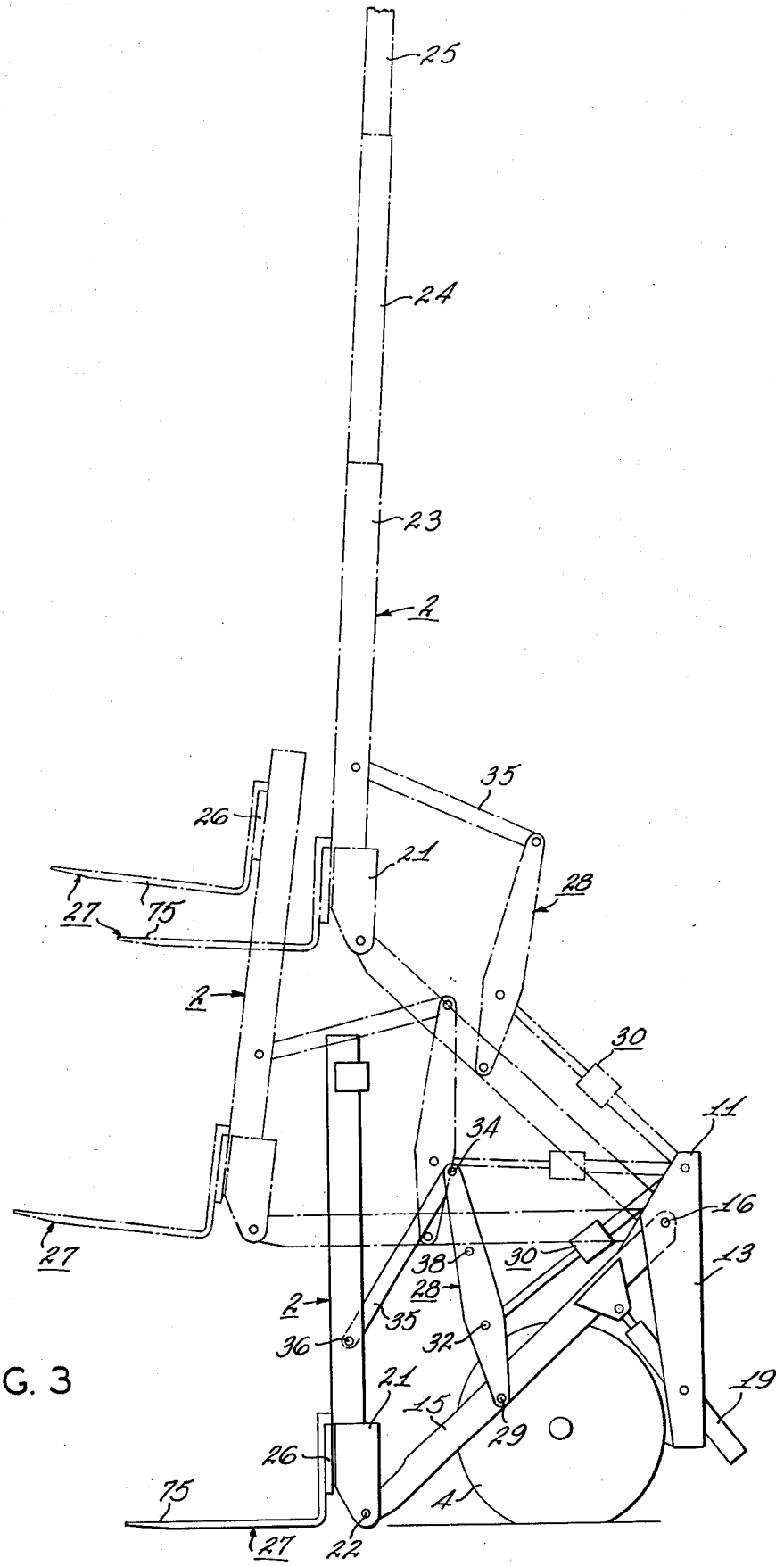
FIG. 3 illustrates a side elevation view of the vehicle with a mast and forklift carriage and various positions of the load carrying mechanism as the boom moves upwardly without altering the length of the leveling cylinder.

The booms 15 are connected to the base 21 on the mast 2 by means of pins 22. The mast 2 is a three section mast as shown in FIG. 3 which has slide rails 23, 24 and 25 which telescope within each other as the mast is extended.

The mast 2 supports a carriage 26 which includes a fork 27 and a suitable carriage supporting mechanism in the slide rails to allow the carriage to move upwardly and downwardly in response to controls at the operator station 5. A suitable hydraulic system also provides for raising and lowering of the carriage in response to controls at the operator station.

The booms 15 support a pair of crossarms 28 which are pivotally supported by means of pins 29 carried on the intermediate portion of the booms 15. The leveling cylinders 30 are connected by pins 72 between the upright supports 13 and the crossarms 28. Each crossarm 28 is provided with a pair of holes for receiving pins to adapt its use to support of a mast 2 as shown. The hole 31 receives a pin 32 for connecting the front end of the leveling cylinder to the crossarm 28. The hole 33 receives a pin 34 for connecting the leveling link 35 to the upper end of the crossarm 28 while the other end of link 35 is connected to the mast 2. The leveling link 35 is connected by a pin 36 to the bracket 37 on the mast 2. Although only a single boom, crossarm and leveling link 35 appear in the side view, the preferred embodiment of this invention incorporates two booms 15, two crossarms 28 and two leveling links 35 as well as two leveling cylinders 30.

The crossarm 28 is also provided with the openings 38 and 39 which are adapted for receiving pins for connecting the leveling link 35 and leveling cylinder 30 respectively adapting the load carrying mechanism for carrying a bucket attachment.

Figure 2:
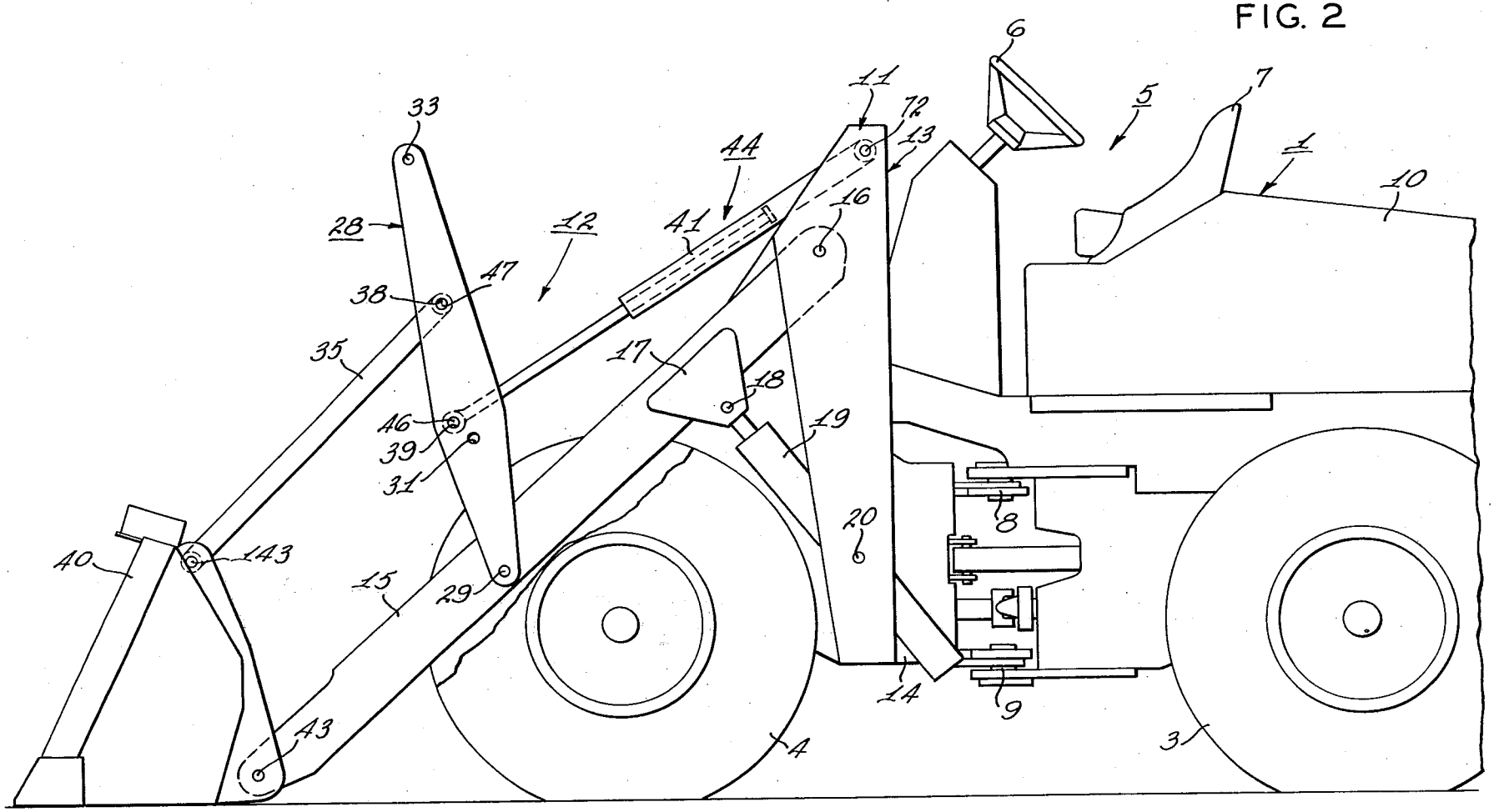
FIG. 2 illustrates a side elevation view of the material handling vehicle with the load carrying mechanism supporting a bucket attachment.

FIG. 2 illustrates the same vehicle 1 in which the load carrying mechanism 12 carries a bucket 40. The upright supports 13 carry the booms 15 which are pivotally connected by a pin 43 to the bucket 40. The links 35 are connected by a pin 143 to the bucket 40. The hydraulic leveling cylinders 41 provide for leveling by the leveling linkage 44. Preferably, each of the hydraulic leveling cylinders 41 has a smaller diameter than the cylinder 30 and has a longer stroke than the cylinder 30 used for the mast load carrying mechanism 12 as shown in FIG. 1. The leveling cylinder 41 is connected by means of the pins 46 and to the hole 39 to the crossarm 28. A pin 47 in hole 38 connects the crossarm 28 to the link 35. It is noted that the holes 38 and 39 are closer together to provide the control necessary for the bucket 40 as contrasted to the holes 33 and 31 as described previously in FIG. 1 for the mast carrying mechanism.

FIG. 3 illustrates the leveling cylinder 30 having a constant length as the forklift mast and carriage 26 is raised. The movement of a load on the forklift carriage 26 will be substantially vertical although the base 21 of the mast 2 arcs slightly forward as the mast is raised.

The operation of this device will be described in the following paragraphs.

Referring to FIG. 2, the material handling vehicle 1 is shown carrying a bucket 40. Each upright support 11 carries a boom 15 which in turn supports the bucket 40. Each leveling linkage 44 includes the leveling cylinder 41 connected between the crossarm 28 and the upright support 11. Each leveling cylinder 41 is connected by an intermediate hole 39 and pin 46 and pin 47 in hole 38 connects the link 35 to the crossarm 28. The link 35 controls the leveling position of the bucket 40. As the load carrying mechanism 12 is operated, the leveling linkage 44 controls the leveling position of the bucket 40 in response to controls at the operator station.

When it is desired to change the bucket 40 for the mast 2, the leveling cylinder 30 is repositioned to pivotally connect the crossarm 28 by means of the pin 32 in hole 31. The leveling link 35 is repositioned from the hole 38 to the hole 33 and is connected by pin 34. The link 35 is connected by pin 36 to the bracket 37 on the mast 2 while the boom 15 is connected by pin 22 to the mast 2.

It is noted that the quadrilateral linkage 70 forms a diverging linkage between the upright support 11 and the crossarm 28. In other words, the positions of the connecting pins 32 and 29 connecting the leveling cylinder 30 and the boom 15 to form the forward link by the crossarm 28 of the quadrilateral linkage 70 is a greater distance than the distance between the pin 16 and the pin 72 on the upright supports. The quadrilateral linkage 74 is a converging linkage between the connections of the pin 34 and the pin 29 to the crossarm 28 and the distance between the pins 36 and 22 on the mast. If these quadrilateral linkages were parallelograms, then theoretically the mast if in the vertical position as shown in FIG. 1 will remain in a vertical position when raised to the position shown in FIG. 3. The quadrilateral linkages, however, are not parallelograms and accordingly, the movement of one of the linkages will compensate for the tilting action produced by the other linkage and the mast tilts slightly rearwardly, as the mast 2 is raised and the base 21 pivots forwardly from the pivot point of pin 16 on the boom 15. The mast can be held in a vertical position by compensating through the leveling cylinder 30 if desired.

If, however, the leveling cylinder 30 is not actuated and the link formed by the leveling cylinder 30 remains the same length as the mast is raised as shown in FIG. 3, the mast tilts rearwardly as the mast is raised and the base 21 arcs slightly forwardly as shown. It is noted that when the fork carriage 26 is raised to a position of approximately the height of the upright supports 13, as shown in FIG. 3, it will move in substantially a vertical path in spite of the fact that the boom connection with the base 21 of the mast 24 arcs forwardly from its extreme lower position. Since the forward ends of the tines 75 of the fork 27 tilt upwardly as the mast tilts rearwardly, the load on the carriage 26 will have stable support on the carriage. In the event of failure of the hydraulic lines, the load will not create an unstable condition of the vehicle and produce a hazard to the operator. The compensating quadrilateral linkages as shown provide good weight distribution on the vehicle as the mast is lifted. The leveling cylinder 30 has a larger piston area than the cylinder 41 to provide greater load carrying capacity and a slower movement in tilting of the mast 2 to provide greater control on the mast. It is understood that either cylinder could be used depending on the load carried by the mast. If, however, a large load is carried on the carriage supported on the mast, it is preferred to use the larger area piston cylinder 30. The large cylinder as shown also limits the tilt of the mast to approximately 15° fore and aft. This tilt angle of the fork is considered small enough so the load will not slide and it will be retained on the fork. The tilt limits of the cylinder are shown in FIG. 1 when the mast is in the lowered position.

It is noted that weights 76 are positioned on the rear end of the vehicle 1 to increase the stability of the vehicle since the mast can extend a substantial distance in the air and the weight of the mast is positioned forward of the center gravity of the vehicle.

The embodiments of the invention in which an exclusive property or privilege is claimed are defined as follows:

1. A load carrying mechanism for a material handling tractor comprising, support means including upright supports on a chassis, boom means pivotally supported on said upright supports, at least one lift cylinder pivotally mounted on said support means and pivotally connected to said boom means to pivotally lift said boom means, at least one crossarm pivotally supported on said boom means, a leveling cylinder pivotally connected between said support means and said crossarm, a leveling link pivotally connected to said crossarm, a load carrying attachment pivotally connected to said leveling link and pivotally mounted on said boom means, said attachment selectively and alternatively including a mast supporting a forklift carriage and a material handling bucket, said crossarm defining a first pair of holes with a first hole receiving a pin connected to said leveling cylinder and a second pin received in a second hole connected to said leveling link whereby said boom means and said leveling link operate said material handling bucket, said crossarm defining a second pair of holes with a third hole receiving a pin connected to said leveling cylinder and a fourth hole receiving a pin connected to said leveling link whereby said boom means and said leveling link operate said mast supporting said forklift carriage, and wherein said leveling cylinder and link, when connected to said second pair of holes, have a substantially different operating geometry than when connected to said first pair of holes.

2. A load carrying mechanism for a material handling tractor as set forth in claim 1 wherein said attachment defines a mast carried on said boom means and said leveling link, said mast supports said forklift carriage adapted for carrying a load.

3. A load carrying mechansim for a material handling tractor as set forth in claim 1 wherein said attachment includes said material handling bucket for carrying loose material.

4. A load carrying mechanism for a material handling tractor as set forth in claim 1 wherein said crossarm defining said pairs of holes includes means defining four holes extended along the length of said crossarm for connecting said crossarm to said leveling cylinder and said leveling link, one of said pins pivotally connecting said leveling cylinder to the crossarm by the extreme lower hole, one of said pins connecting the extreme upper hole to said leveling link thereby adapting said mechanism to operate said mast supporting said forklift carriage.

5. A load carrying mechanism for a material handling tractor as set forth in claim 1 wherein said crossarm defining said pairs of holes includes means defining four holes extended along the length of said crossarm, one of said pins received in the lower of the two intermediate holes to connect to said leveling cylinder, one of said pins received in the upper of the two intermediate holes to connect to said leveling link thereby adapting said mechanism for operating said material handling bucket.

6. A load carrying mechanism for a material handling tractor as set forth in claim 1 wherein said leveling link, the forward portion of said boom means, said crossarm and said attachment defined a quadrilateral linkage and said leveling link defines a link longer than the link formed by said boom means.

7. A load carrying mechanism for a material handling tractor as set forth in claim 1 wherein said pairs of holes in said crossarm defines at least two holes for selectively receiving one of said pins for connecting said crossarm to said leveling cylinder, and at least two holes for selectively receiving one of said pins for selectively connecting said leveling link to said crossarm.

8. A load carrying mechanism for a material handling tractor as set forth in claim 1 wherein said crossarm forms an aft quadrilateral linkage with said leveling cylinder, said upright supports and a rearward portion of said boom means, said crossarm forms a fore quadrilateral linkage with said leveling link, the forward portion of said boom means and said attachment.

9. A load carrying mechanism for a material handling tractor as set forth in claim 1 wherein said crossarm forms an aft forwardly divergent quadrilateral linkage with said leveling cylinder, said upright support, and the rearward portion of said boom means, said crossarm forms a fore forwardly converging quadrilateral linkage with said leveling link, the forward portion of said boom means, and said attachment, said fore and aft quadrilateral linkages provide a compensating vertically aligning means whereby said attachment is tilted slightly rearward as said boom means initially arcs the base of said attachment slightly forwardly as said boom means pivots upwardly.

10. A load carrying mechanism for a material handling tractor as set forth in claim 1 wherein said crossarm forms an aft forwardly diverging quadrilateral linkage with said leveling cylinder, said upright support, and the rearward portion of said boom means, said crossarm forms a forwardly converging quadrilateral linkage with said leveling link, said attachment, and the forward portion of said boom means, said attachment includes a mast having a forklift carriage adapted for slidably moving on said mast whereby when said forklift carriage is in the partially raised position said forklift carriage will move through a substantially vertical movement when said boom means arcuately raises the base of said mast thereby tilting said mast slightly rearward as said mast is initially raised.

* * * * *